United States Patent [19]

Fallen

[11] 4,069,538

[45] Jan. 24, 1978

[54] DRIVE DISC AND PAD ASSEMBLY FOR FLOOR BUFFER

[76] Inventor: Burke R. Fallen, 1315 Buck St., Eugene, Oreg. 97402

[21] Appl. No.: 701,522

[22] Filed: July 1, 1976

[51] Int. Cl.[2] ..... A47L 11/14

[52] U.S. Cl. ..... 15/230.17; 15/98; 15/230.1; 51/356

[58] Field of Search ..... 15/49 R, 50 R, 93 R, 15/98, 180, 230, 230.1, 230.14, 230.16, 230.17, 230.19, 230.12, 230.15, 230.16, 385; 51/266, 356

[56] References Cited

U.S. PATENT DOCUMENTS

| | | | |
|---|---|---|---|
| 2,008,260 | 7/1935 | Reineman | 15/230.17 X |
| 2,410,812 | 11/1946 | Michel | 15/230.1 X |
| 3,067,549 | 12/1962 | Laverdisse | 15/230.17 |
| 3,619,848 | 11/1971 | Salzmann | 15/50 R X |
| 3,623,177 | 11/1971 | Pack | 15/50 R |
| 3,754,359 | 8/1973 | Scandalestos | 51/356 |

*Primary Examiner*—Edward L. Roberts
*Attorney, Agent, or Firm*—Warren, Chickering & Grunewald

[57] ABSTRACT

In a floor buffing machine, a rotating pad support structure for the conventional porous fibrous floor buffing pad in which airways are provided in the structure in conjunction with means for inducing airflow through the pad and airways.

3 Claims, 4 Drawing Figures

DRIVE DISC AND PAD ASSEMBLY FOR FLOOR BUFFER

BACKGROUND OF THE INVENTION

The invention relates to power-driven floor buffing machines and, more particularly, to the pad supporting structure for the common fibrous "hogs hair" type of pad. The structure of the present invention is particularly adapted for use in high speed floor buffing machines, such as disclosed in my co-pending Application Ser. No. 352,613, now U.S. Pat. No. 3,977,421.

SUMMARY OF INVENTION

An object of the present invention is to provide improved means for supporting the buffing pad during its high speed rotation, enabling it to better and longer perform its effective buffing action.

Another object of the present invention is to provide a pad support structure of the character above in which advantage is taken of the high speed rotation to obtain a cleansing, air-flushing action through the pads, thereby prolonging its effective buffing action.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
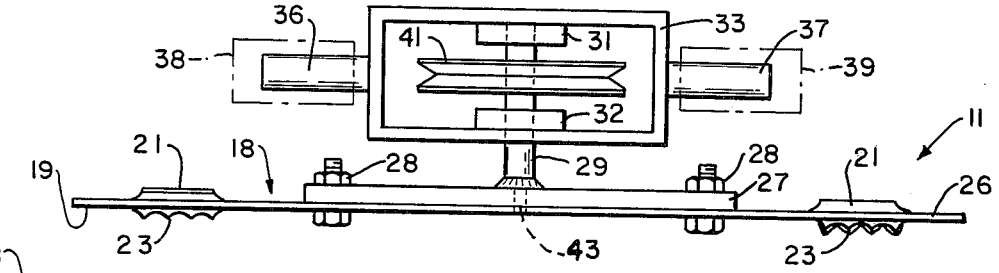
FIG. 1 is a side elevation of a pad support structure for floor buffing machines constructed in accordance with the present invention.
Figure 4:
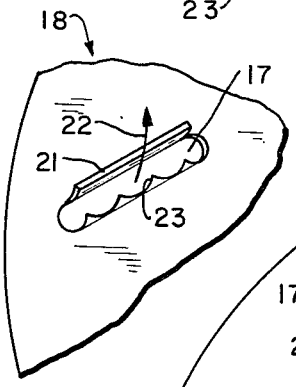
FIG. 4 is an enlarged fragmentary perspective view of a portion of the structure indicated by the line 4—4 of FIG. 2.

The present invention comprises, briefly, a rotating pad support structure 11 adapted to secure and mount in contact with a floor 12 to be buffed and to rotationally drive a conventional porous fibrous "hogs hair" type floor buffing pad 13; and means providing airways 17 in the pad support structure in communication with pad 13 and inducing, upon rotation, an airflow through the pad and airways. More specifically, a pad support structure comprises a drive plate 18 having a normally horizontal planar position in use, as seen in FIG. 1, with pad 13 mounted on its underside 19. Plate 18 is here formed with a plurality of openings therethrough providing airways 17; and vanes 21 are carried by plate 18 and associated with openings 17 for inducing a normally upward airflow through the pad and openings, as depicted by arrows 22 in FIGS. 3 and 4.

As a feature of the present invention, plate 18 is also provided with means 23 depending from underside 19 for piercing pad 13 for joint movement of the pad and plate and for restraining the pad against centrifugal expansion. Means 23 may, as here shown, be formed of the material of plate 18, struck downwardly out of openings 17; and, preferably, are sharpened in the form of teeth so as to readily enter into the top surface 24 of pad 13. At The same time, material at the opposite side of the openings may be struck up out of the openings to provide the vanes 21.

As will be observed from the drawings, the rotating pad support structure is here formed of a substantially circular flat disc shape plate having a diameter substantially equal to the diameter of the standard commercial fibrous "hogs hair" type floor buffing pad, nominally 16–18 inches, and is fastened to the underside of a circular drive plate 27 concentrically therewith by means of a plurality of bolts 28 threaded through aligned openings in plates 26 and 27 in substantially equally circumferentially spaced relation around the center of the plates. A drive shaft 29 is connected to the center of plate 27 and extends perpendicular to and is journalled in bearings 31 and 32, supported by a surrounding yoke frame 33. The latter is provided with a pair of coaxial horizontally extending shaves 36 and 37, which are journalled in bearings 38 and 39 of the floor buffing machine of the general type disclosed in my above-identified co-pending application. These machines comprises a wheel-mounted carriage containing bearing 38 and 39, permitting articulation of plate 26 to provide self-adjustment of pad 13 carried thereby into planar contact with the floor to be buffed, and a motor for driving the pad. Power connection to the pad may be made by a belt entrained around a pulley 41 mounted on shaft 29 between bearings 31 and 32. A drive ratio is selected to rotate the pad-supporting structure at a minimum speed of about 1,000 rpm. A common speed range for this type of machine is from about 900 to 1,000 rpm on the low side to 1,500 to 1,600 rpm on the high side. It is essential that the motor have sufficient power to drive the buffing pad at such elevated speeds.

Figure 2:
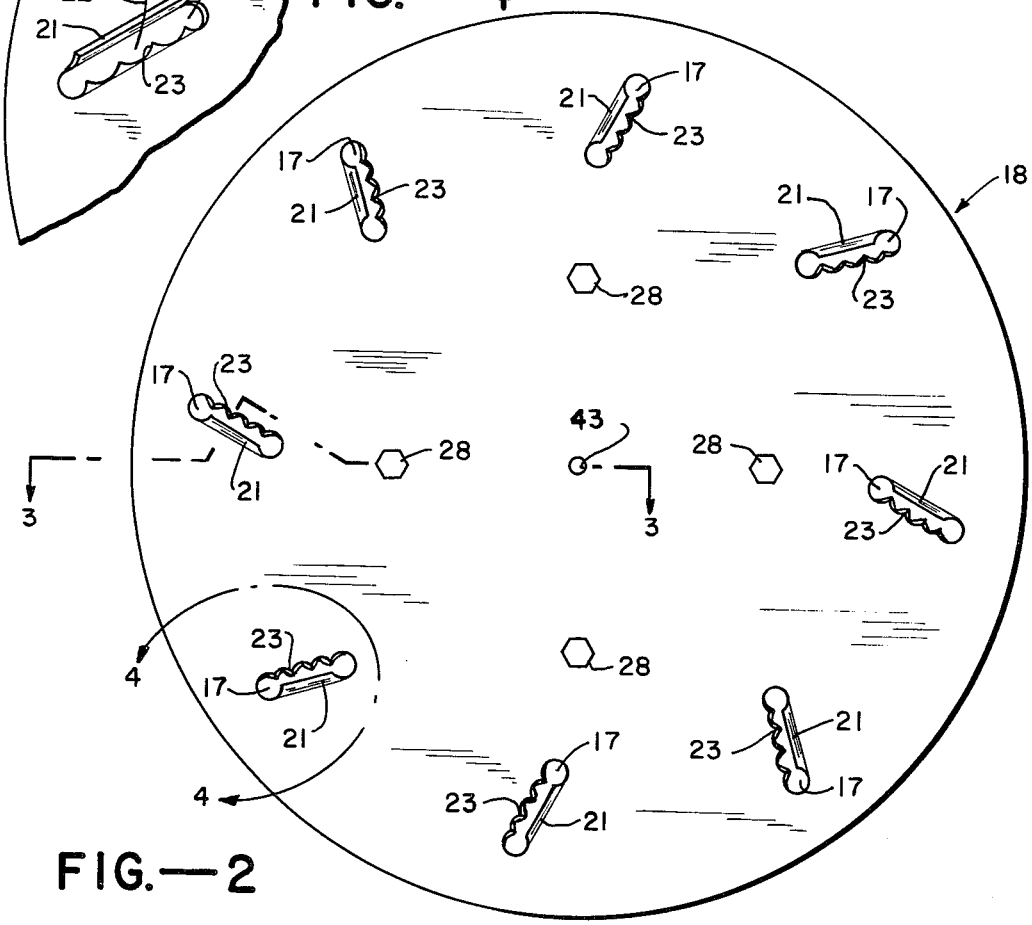
FIG. 2 is a bottom plan view of the structure.

As will be observed from FIG. 2, the openings 17, vanes 21 and pad-piercing means 23 are disposed in substantially equally circumferentially spaced position around the rotating axis of shaft 29 so as to provide a dynamically balanced structure. As will be seen from FIG. 3, plate 26 is of substantially larger diameter than plate 27, so that the airways 17, vanes 21 and piercing means may be conveniently located between the peripheries of plates 26 and 27 and near the outer periphery of pad 13. As will also be best seen in FIGS. 2 and 4, the downturned projections 23 are preferably formed as depending teeth for biting into the top surface pad 13.

Pad 13, as above noted, is a standard commercially available, porous, fibrous "hogs hair" type pad. It is conventionally fabricated as a mass of bristles of natural or synthetic material held together by a latex or similar binding material. The result is a fibrous porous pad which may be cut to desired size. Normally the pad has a thickness of about 1 inch. This general type of porous, fibrous pad is produced by a number of manufacturers, including Fleetwood Industries, Fleetwood, Pennsylvania.

Figure 3:
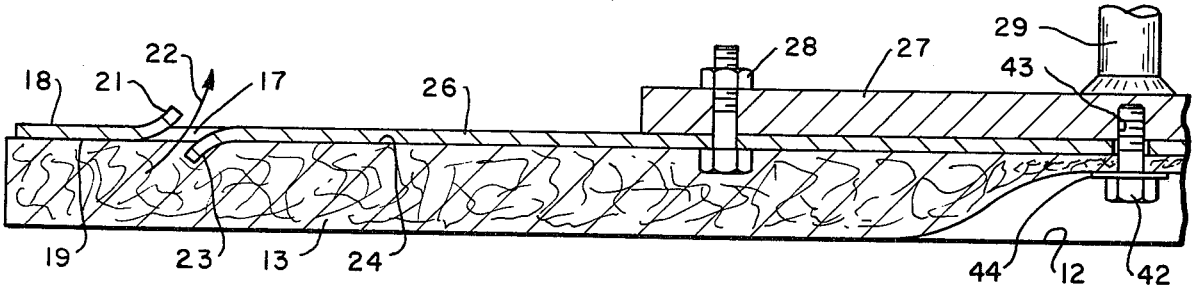
FIG. 3 is an enlarged fragmentary cross-sectional view taken substantially on the plane of line 3—3 of FIG. 2.

Demountable securing of pad 13 to the underside 19 of plate 26 is here effected by bolt 42, passed through the center of pad 13 and threaded into an opening 43 provided in drive plate 27 on the axis of shaft 29. A washer may be placed under the head of bolt 42 for increasing the cinching area of pad 13. Due to the open mesh compressive nature of pad 13, bolt 42 will normally be tightened, as illustrated in FIG. 3, to tightly secure the pad in place. As the weight of the buffing machine is placed on the upper surface of pad 13, teeth 23 will project into the pad, further anchoring it for rotation with plate 26 and restraining the pad against centrifugal expansion. Also, due to the open mesh structure of the pad, air can be drawn freely through the pad in a cleansing, air-flushing action, thus extending the normal effective life of the pad.

What is claimed is:

1. In a floor buffing machine, a rotating pad support structure adapted to secure and mount in contact with a floor to be buffed and to rotationally drive a porous floor buffing pad, said structure comprising a drive plate having a normally horizontal planar position in use with said pad mounted on the underside thereof, said plate being formed with a plurality of openings therethrough providing airways in communication with said pad;

a vane carried by said plate at one side of each of said openings and inducing upon rotation of said plate a normally upward airflow through said pad and openings; and means depending from said plate at the opposite sides of said openings and piercing said pad for joint movement and for restraining said pad against centrifugal expansion.

2. A pad support as defined in claim 1, the material of said plate being turned up at one side of said openings to provide said vanes and turned down at the opposite side of said openings to provide said pad-piercing means.

3. A pad support as defined in claim 1, said plate being of substantially circular flat disc shape;

a drive shaft connected to the center of said plate and extending perpendicular thereto; and said openings and vanes and pad-piercing means being disposed in substantially dynamically balanced circumferentially spaced position around the axis of said shaft.

* * * * *

UNITED STATES PATENT AND TRADEMARK OFFICE

CERTIFICATE OF CORRECTION

PATENT NO. : 4,069,538

DATED : January 24, 1978

INVENTOR(S) : BURKE R. FALLEN

It is certified that error appears in the above-identified patent and that said Letters Patent are hereby corrected as shown below:

IN THE CLAIMS:

Claim 1, line 4, after "porous" insert ---fibrous---.

IN THE SPECIFICATION:

Col. 2, line 3, after "At" delete "The" and insert ---the---;

Col. 2, line 24, after "machines" delete "comprises" and insert ---comprise---; and Col. 2, line 48, after "surface" insert ---of---.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*